US005810357A

United States Patent [19]

Brink

[11] Patent Number: 5,810,357

[45] Date of Patent: Sep. 22, 1998

[54] STACKABLE THREE-DIMENSION TOY ASSEMBLY

[76] Inventor: Eugene Loring Ten Brink, 17 E. Kossuth St., Columbus, Ohio 43206

[21] Appl. No.: 933,864

[22] Filed: Sep. 19, 1997

[51] Int. Cl.[6] ..... A63F 9/08

[52] U.S. Cl. ..... 273/157 R; 273/156; 446/117

[58] Field of Search ..... 273/157 R, 156, 273/153 R; 446/117, 118, 97

[56] References Cited

U.S. PATENT DOCUMENTS

| | | | |
|---|---|---|---|
| 2,493,697 | 1/1950 | Raczkowski | 273/157 R |
| 2,725,234 | 11/1955 | Coble et al. | 273/157 R |
| 2,839,842 | 6/1958 | Keyko | 273/156 |
| 3,350,811 | 11/1967 | Bender | 446/117 |
| 4,874,176 | 10/1989 | Auerbach | 273/157 R |
| 5,683,086 | 11/1997 | Druckman et al. | 273/157 R |
| 5,700,177 | 12/1997 | Lemelson | 273/156 |

*Primary Examiner*—Steven B. Wong
*Attorney, Agent, or Firm*—Thomas S. Baker, Jr.

[57] ABSTRACT

A three-dimension skill-development toy for small children is provided with a molded core element and a series of planar elements that may be stacked on the molded core element only by pattern matching and in one particular sequence to form a resulting fanciful and pleasing unitary shape.

3 Claims, 2 Drawing Sheets

STACKABLE THREE-DIMENSION TOY ASSEMBLY

FIELD OF THE INVENTION

This invention relates generally to toys for children, and particularly concerns an stackable three-dimension toy which may be advantageously provided to a child for use to increase his or her pattern shape recognition, pattern matching, and pattern sequence recognition skills during assembly of the toy.

BACKGROUND OF THE INVENTION

Numerous different forms of spatial pattern recognition and spatial pattern matching toys suitable for small children are known. For instance, U.S. Pat. No. 2,327,718 to Kassler discloses a child's toy having stackable pieces but does not involve piece sequencing.

Many other issued patents also disclose a multi-piece toy, and different types and degrees of pattern recognition and pattern matching are involved. Some of such patents are further identified and summarized immediately following.

U.S. Pat. No. 2,399,599 granted to Owen also discloses a child's toy having stackable pieces but its use develops neither pattern sequencing nor pattern matching skills.

U.S. Pat. No. 4,259,804 granted to Samuels provides a toy with stackable facial-expression puzzles, and although its use helps develop pattern recognition and pattern matching skills, there is no requirement for particular pattern sequencing.

U.S. Pat. No. 4,356,659 to Clarke teaches a take-apart doll that comprises a stackable three-dimension toy but un-necessarily includes an articulated doll head component that functions as a puzzle successful completion reward. Also, assembly of doll component parts in a particular order is not necessary.

U.S. Pat. No. 5,104,345 issued in the name of Lyman discloses a multi-piece toy that can be stacked in a three-dimension configuration but does not require that the user assemble toy pieces in a particular sequence.

U.S. Pat. No. 5,224,895 to Franz is for a toy that teaches the structuring of various fanciful animal facial constructions.

U.S. Pat. No. 5,498,189 granted to Townsend teaches a puppet construction utilizing interchangeable face components, but toy assembly in a particular part sequence is not required.

See also U.S. Pat. Nos. 4,846,750 and 4,897,066, each granted to Tadrup, for details of a widely-used "Lego" type of multi-piece toy that requires assembly but not with a particular piece sequence.

I have discovered a novel stackable three-dimension toy that may be utilized to advantageously develop child skills pertaining to spatial pattern recognition, matching, and sequencing and thereby overcome shortcomings associated with the known art. Other advantages of the invention will become apparent during consideration of the descriptions, drawings, and claims which follow.

SUMMARY OF THE INVENTION

In order to achieve the objects of my invention I provide a multi-piece toy assembly comprised of a plurality of pieces that when stacked in a specific sequence result in a pleasing and fanciful three-dimension unitary shape. The toy assembly includes: a molded core element having a plurality of adjacent zones along its longitudinal axis, each zone having a different cross-section configuration; and a plurality of unitary shape planar elements each having a different planform and a different central opening that corresponds in configuration to but one of the core element adjacent zone configurations. One of the toy assembly planar shape elements co-operates with one end zone of the molded core element to form a base combination. Another of the planar shape elements is made of a resilient material, has a an undersized central opening that corresponds in configuration to a the core element other end zone, and, by friction fit with the core element end, functions as a fastener to retain the toy pieces in their sole unitary shape when properly assembled upon the base combination.

DETAILED DESCRIPTION

Figure 1:
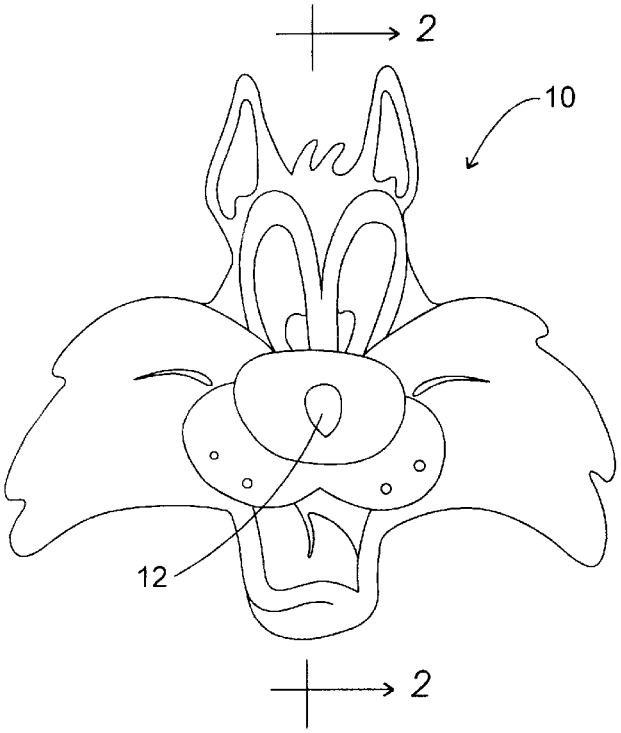
FIG. 1 is plan view of a preferred embodiment of the multi-piece stackable three-dimension toy of the present invention.
Figure 2:
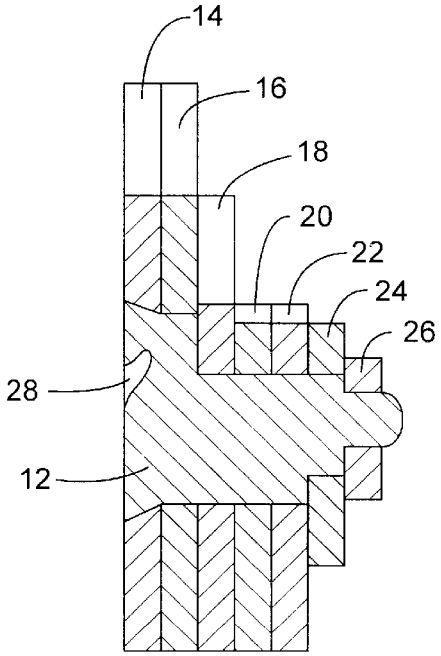
FIG. 2 is a section view taken along line 2—2 of FIG. 1.
Figure 3:
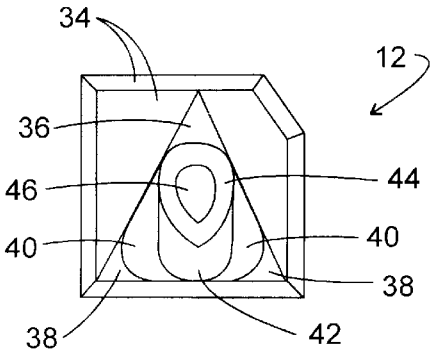
FIG. 3 is a plan view of the molded core element of the invention.
Figure 4:
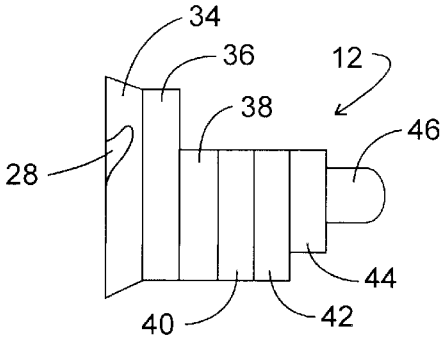
FIG. 4 is an side elevation view of the molded core element illustrated in FIGS. 3.
Figure 5:
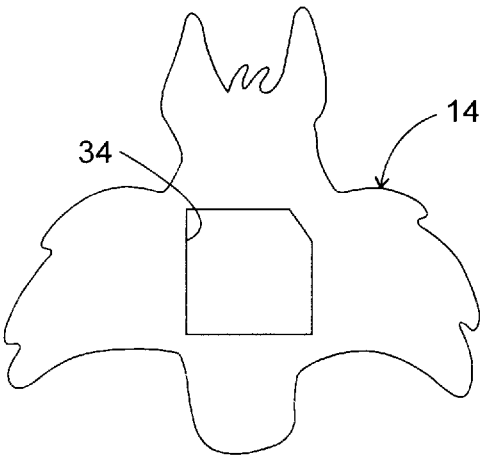
FIGS. 5 through 11 are plan views of the different unitary shape planar elements included in the toy assembly of FIGS. 1 and 2.
Figure 6:
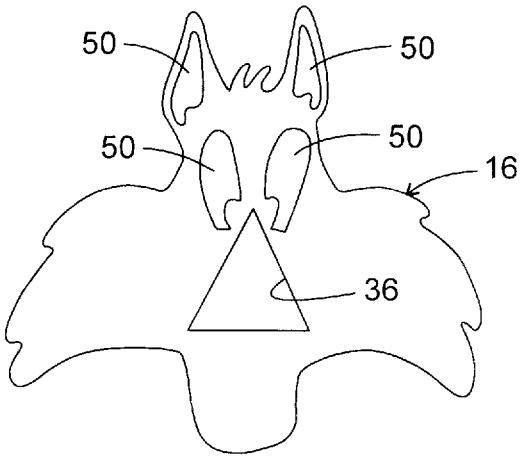
Figure 7:
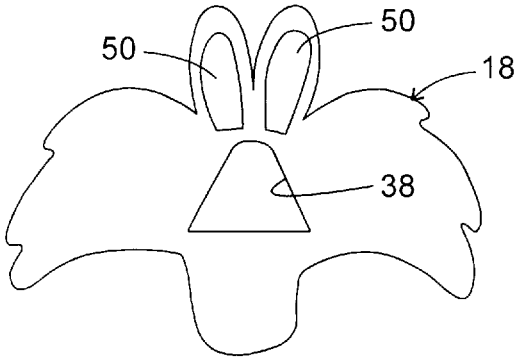
Figure 8:
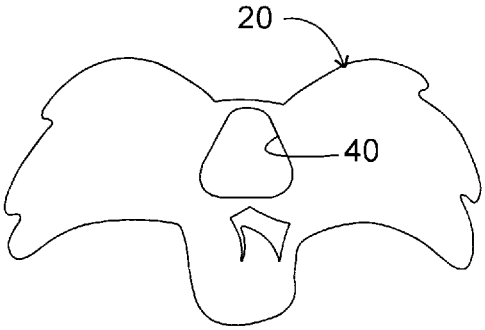
Figure 9:
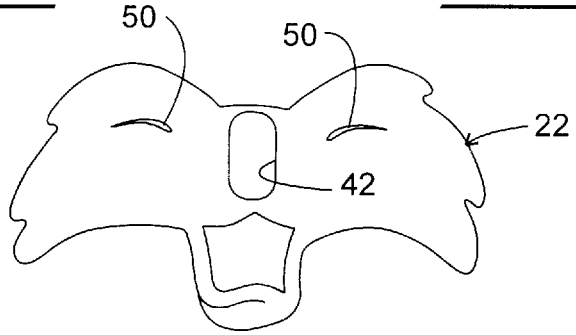
Figure 10:
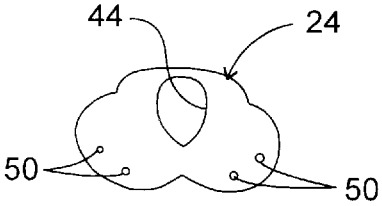
Figure 11:
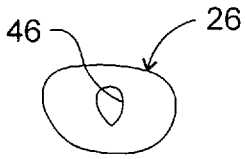

In FIG. 1 I schematically illustrate a preferred embodiment 10 of the stackable three-dimension toy of the present invention. The toy 10 is essentially comprised of a molded core element 12 and the unitary shape planar elements 14 through 26 mounted on core element 12. A recess 28 may optionally be provided in the underside of core element 12 to facilitate hanging completely assembled toy 10 on a wall hook as a wall decoration.

It should be noted that although the exterior configuration of three-stackable three-dimension toy 10 of FIG. 1 is that of a fanciful head of a wolf, the invention is not to be limited to that particular unitary design or shape. The toy three-dimension overall shape may take any one of an almost infinite number of pleasing configurations such as another animal head, a mountain, a tree, a flower, a human being, or the like.

Molded core element 12 is comprised, along its longitudinal axis, of a series of adjacent zones that each has a different one of configurations 34 through 46 for its zone shape. Each of zone shape configurations 34 through 46 essentially corresponds to a like-numbered interior opening configuration 34 through 46 provided in a respective one of planar shape elements 14 through 26. See FIGS. 5 through 11.

Configurations 34 through 46 are each selected to be different from every other configuration. Configurations 36 through 46 may be symmetrical about one axis, but configuration 34 is preferably asymmetrical about all axes. The individual configurations are selected and sized so as to be successively smaller in plan area to thus make it impossible to place all of elements 14 through 26 on core element 12 except when placed on the core in the pre-established proper sequence.

I prefer fabricating top planar shape element 26 in a somewhat resilient material with its interior opening 46 being sized to provide a friction fit between core element 12 and shape element 26. Such enables shape element 26 to function as a fastener to retain planar shape elements 14 through 26 in their proper relation following complete assembly of the toy. Following complete assembly, toy 10 may be used as a wall decoration, for instance, with the recess 28 in core element 12 facilitating that use.

To make toy assembly 10 particularly pleasing, planar shape elements 14 through 26 may be manufactured or decorated in different contrasting colors, and some of such planar shape elements may be provided with additional interior openings 50 that permit viewing of a different color of the shape element positioned immediately below.

Various changes may be made in the relative shapes, sizes, and materials of the components of the herein-described stackable three-dimension toy invention without departing from the scope, meaning, or intent of the claims which follow.

I claim my invention as follows:

1. A stackable, three-dimension toy for child skill-training, and comprising:

a molded core element having a series of adjacent zones along its longitudinal axis, each zone having a different cross-section configuration and size; and a series of unitary shape planar elements, each having a central opening that complements, in configuration and size, the configuration and size of a different one of said molded core element zonal cross-sections, said series of unitary shape planar elements having a pre-determined sequence of assembly upon said molded core element to comprise the toy unitary shape, and said molded core element adjacent zones and planar element complementary central openings having configurations of successively smaller area along said molded core longitudinal axis.

2. The invention defined by claim 1, wherein said molded core element and one of said unitary shape planar elements may be assembled only in one direction along said molded core element longitudinal axis to function as a base combination.

3. The invention defined by claim 2, wherein one of said unitary shape planar elements has a central opening configuration and size that comprises a friction fit with the cross-section configuration and size of its respective molded core adjacent zone.

* * * * *